US005885031A

United States Patent [19]

White

[11] Patent Number: 5,885,031

[45] Date of Patent: Mar. 23, 1999

[54] MINE ROOF BOLT ANCHOR

[76] Inventor: Claude White, 3316 Spring Hill Rd., Birmingham, Ala. 35223

[21] Appl. No.: 986,842

[22] Filed: Dec. 8, 1997

[51] Int. Cl.[6] ..... E21D 21/00

[52] U.S. Cl. ..... 405/259.4; 405/259.1; 411/32; 411/349; 411/354

[58] Field of Search ..... 405/259.1, 259.5, 405/259.6, 259.4; 411/44, 57, 72, 27, 28, 32, 349, 354, 238

[56] References Cited

U.S. PATENT DOCUMENTS

| | | | |
|---|---|---|---|
| 4,655,644 | 4/1987 | Lane et al. | 411/44 X |
| 4,696,611 | 9/1987 | Guay | 411/72 X |
| 4,913,593 | 4/1990 | Clark et al. | 405/259.5 X |
| 5,011,337 | 4/1991 | Clark et al. | 405/259.1 X |
| 5,078,547 | 1/1992 | Calandra et al. | 411/44 X |
| 5,344,257 | 9/1994 | Wright et al. | 405/259.1 X |
| 5,413,441 | 5/1995 | Heminger et al. | 411/349 X |

FOREIGN PATENT DOCUMENTS

| | | | |
|---|---|---|---|
| 558463 | 3/1960 | Belgium | 405/259.4 |

*Primary Examiner*—Dennis L. Taylor
*Attorney, Agent, or Firm*—Veal & Associates

[57] ABSTRACT

An anchor for a mine roof bolt incorporates a single large rib at the top of a segmented shell. This single large rib is forced into the wall of the bore hole by the downward movement of an associated threaded camming nut during the first few revolutions of the roof bolt. The remainder of the outer surface is generally smooth or unserrated and provides a large bearing surface which is urged against the bore hole wall upon further rotation of the bolt. The camming nut has a specific shape flaring substantially near its upper end such that a relative large area of the bore hole wall below the rib is forced into compression.

15 Claims, 7 Drawing Sheets

MINE ROOF BOLT ANCHOR

FIELD OF THE INVENTION

The present invention relates generally to the field of mining and more particularly to the field of underground mining such as employed in the mining of coal. In greater particularity the present invention is directed to the safety of the miner and to the securement of the overhead in such a mining operation. In still further particularity, the present invention is related to the anchors which secure bolts within pre-drilled holes in a mine roof to hold the roof against falling.

BACKGROUND OF THE INVENTION

In an underground mine the miner must constantly be concerned about the structure over his head, in as much a the mine is cut through the ground and a tremendous mass of rock or earth overlies the horizontal portion of each mine. To attempt to secure the overhead against unexpected falls, miners have developed a methodology by which the mine roof is ostensibly supported. Holes are drilled into the roof and a plurality of anchors on substantial metal rods are inserted into the holes. A compression plate is secured to the bolts beneath the roof and as the anchors tighten against the compression plate and the anchors serve to provide a region of increased compression which acts to bind the stratus of rock into a beam supporting the remainder of the roof Mine roof anchors inserted into a pre-drilled hole have been the subject of numerous patents. Patents exist on anchors which have serrated outer shells, which have bails, which have a plurality of wall engaging members formed in a stack, and in numerous other configurations.

It appears that the anchors of the past have tended to fracture the wall surrounding the hole incorrectly, using a plurality of serrations or plates to fracture the wall at varying heights about the anchor during the process of compressing the wall to prevent dislodging of the anchor. As the wall is fractured the tendency for the wall to crumble has not been restrained thus rock particulate moves in the path of least resistance, thus into bore holes beneath the multiple fractures. As a result, the roofs supported by the anchors of the day continue to fall, endangering lives and reducing the efficiency of the mining operation.

SUMMARY OF THE INVENTION

It is the object of the present invention to improve the safety of the workplace for miners, to reduce the likelihood of falls in mines where the overhead must be secured, to improve the efficiency of the mining operation, all by providing a superior anchor system for use in underground mines.

It is the further object of the invention to compress the largest volume of rock possible adjacent the mine roof anchor to induce shear stress and compression such that minute particles of rock are forced into a smaller volume and provide greater resistance to downward load on the anchor due to bolt tension.

These and other features of the present invention are accomplished by reducing the number of locations at which the wall surrounding the hole will be fractured and by spreading the compressive forces over the maximum area about the anchor. Specifically the present invention incorporates a single large rib at the top of a segmented shell. This single large rib is forced into the wall of the bore hole by the downward movement of a camming nut during the first few revolutions of the anchor bolt. The remainder of the outer surface is generally smooth or unserrated and provides a large bearing surface which is urged against the bore hole wall upon further rotation of the bolt. The camming nut has a specific shape flaring substantially near its upper end such that a relative large area of the bore hole wall below the rib is forced into compression.

BRIEF DESCRIPTION OF THE DRAWINGS

An anchor embodying the features of my invention is depicted in the accompanying drawings which form a portion of this disclosure and wherein.

DESCRIPTION OF THE PREFERRED EMBODIMENT

Figure 1:
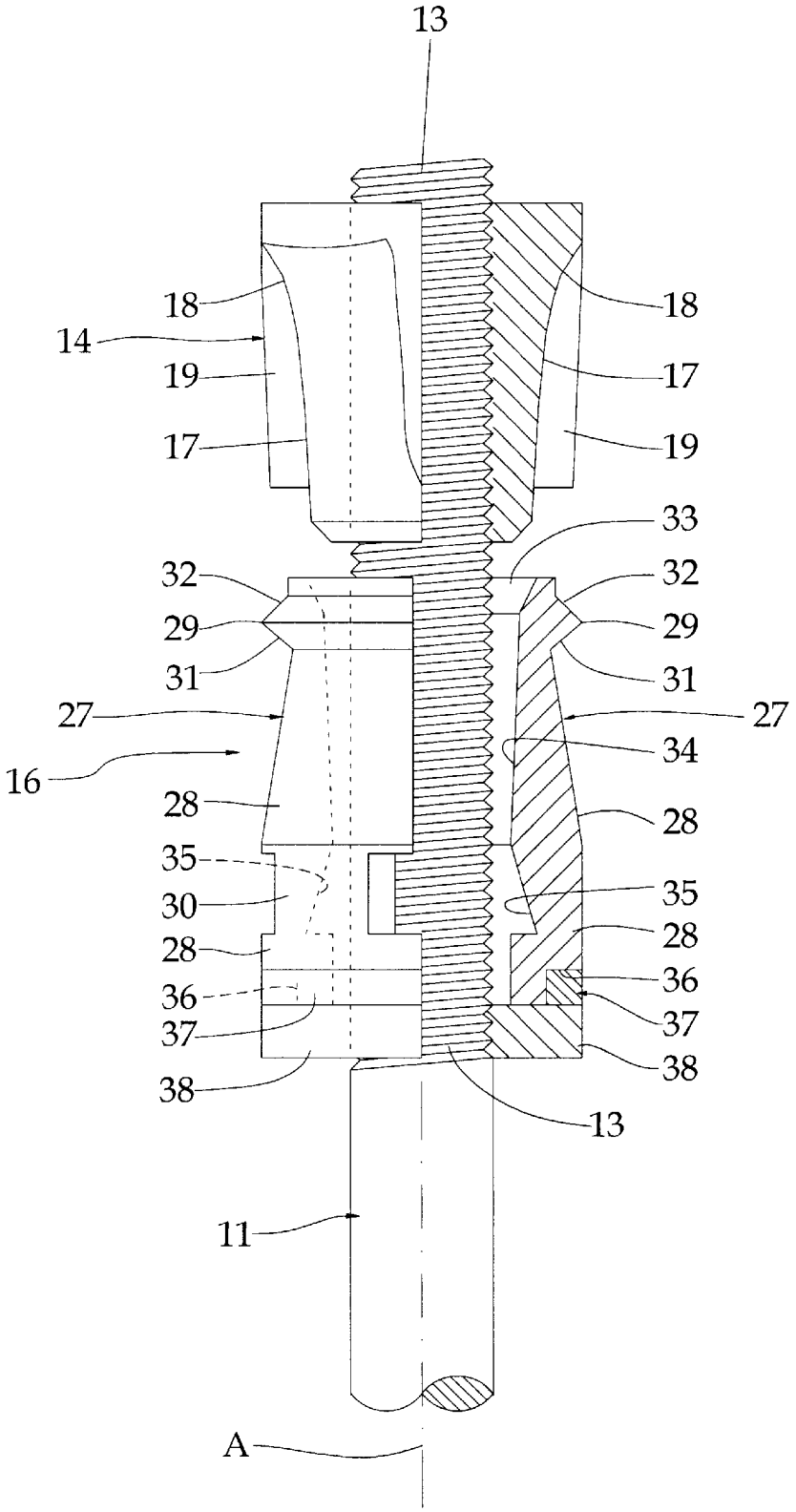
FIG. 1 is a side elevational view of the anchor on a mine roof bolt.

Referring to the drawings for a better understanding of the invention, it may be seen in FIG. 1 that the invention is employed with a cooperative mine roof bolt 11 having a head 12 and a threaded shaft 13. The anchor proper has a camming nut 14 and a shell 16, each circumscribing the shaft 13. Camming nut is formed with a lower portion 17 flaring upwardly at a slight angle relative to vertical and an upper portion 18 flaring outwardly at a much greater angle, for example the lower portion 17 may flare outwardly at an angle of between three and ten degrees and upper portion 18 may flare at an angle of 20 to 30 degrees, with the lower portion being about twice the height of the upper portion the transition in flare being somewhat abrupt. Additionally nut 14 may have formed thereon one or more splines as at 19 or one or more grooves as at 21. Either spline 19 or groove 21 may be used to engage anchor shell 16 to prevent relative rotation between the shell and the nut. However, such splines are not necessary.

Figure 2:
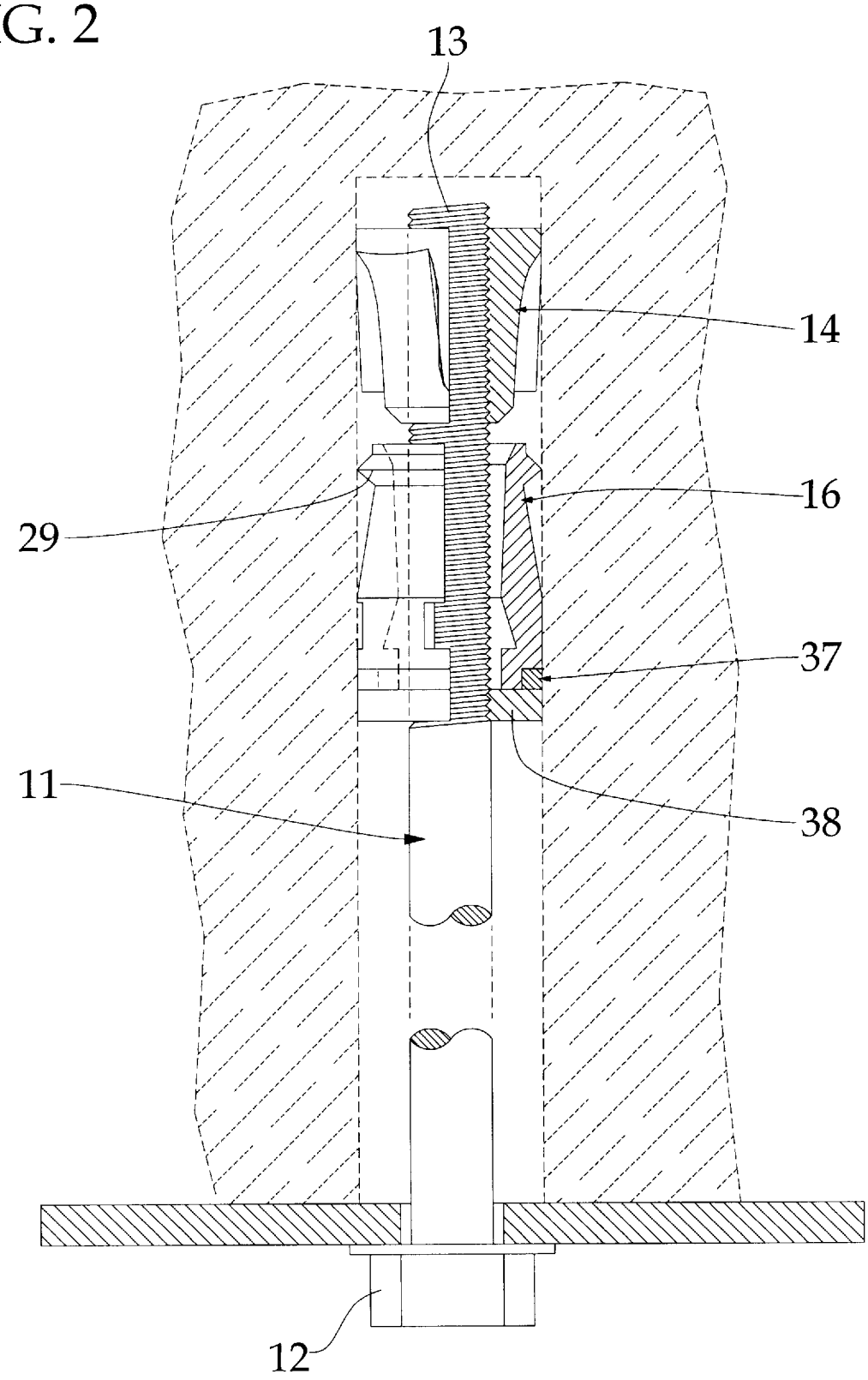
FIG. 2 is a sectional view of the anchor and bolt before compression.
Figure 3:
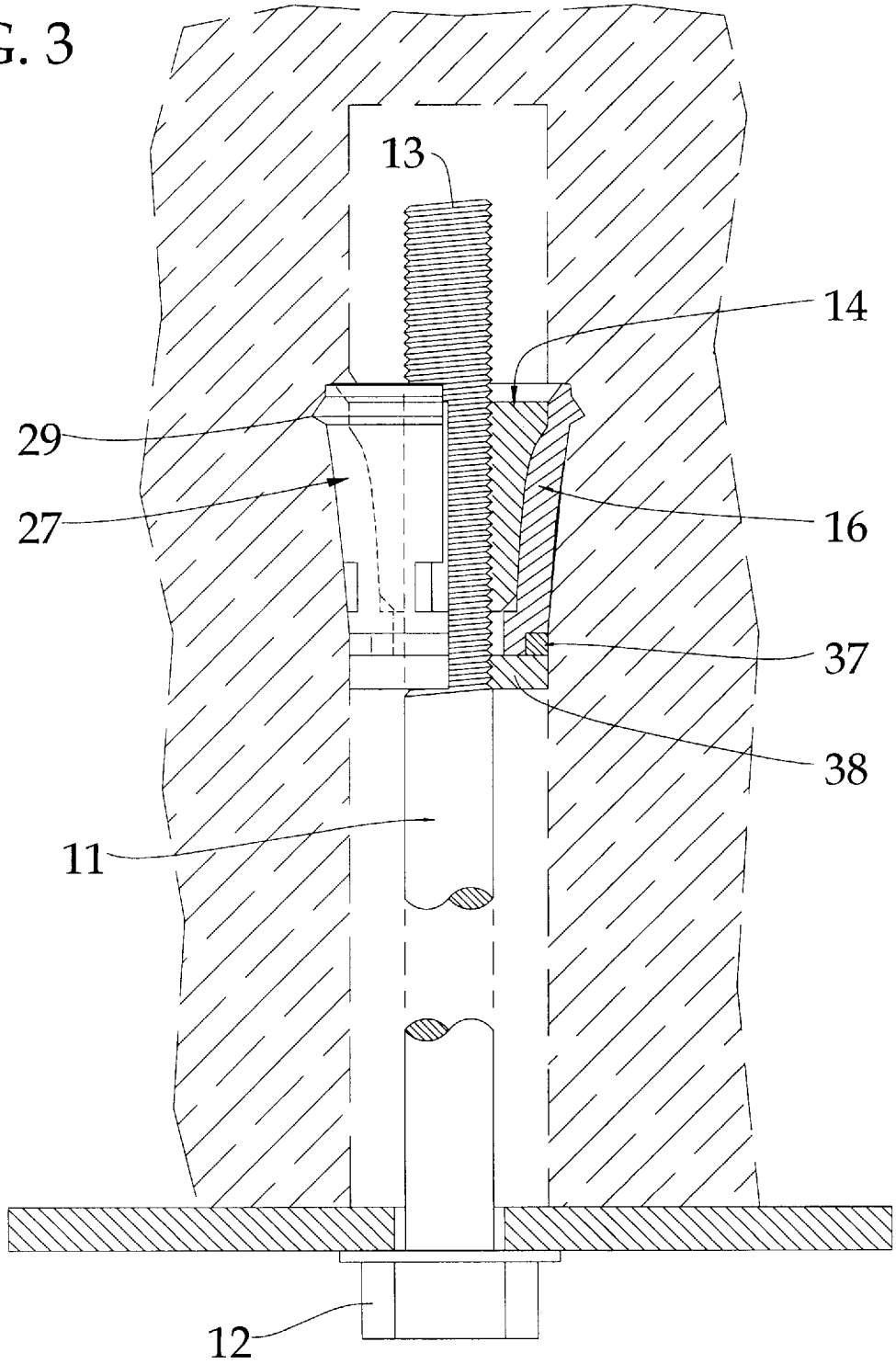
FIG. 3 is a sectional view of the anchor and bolt after compression.
Figure 4:
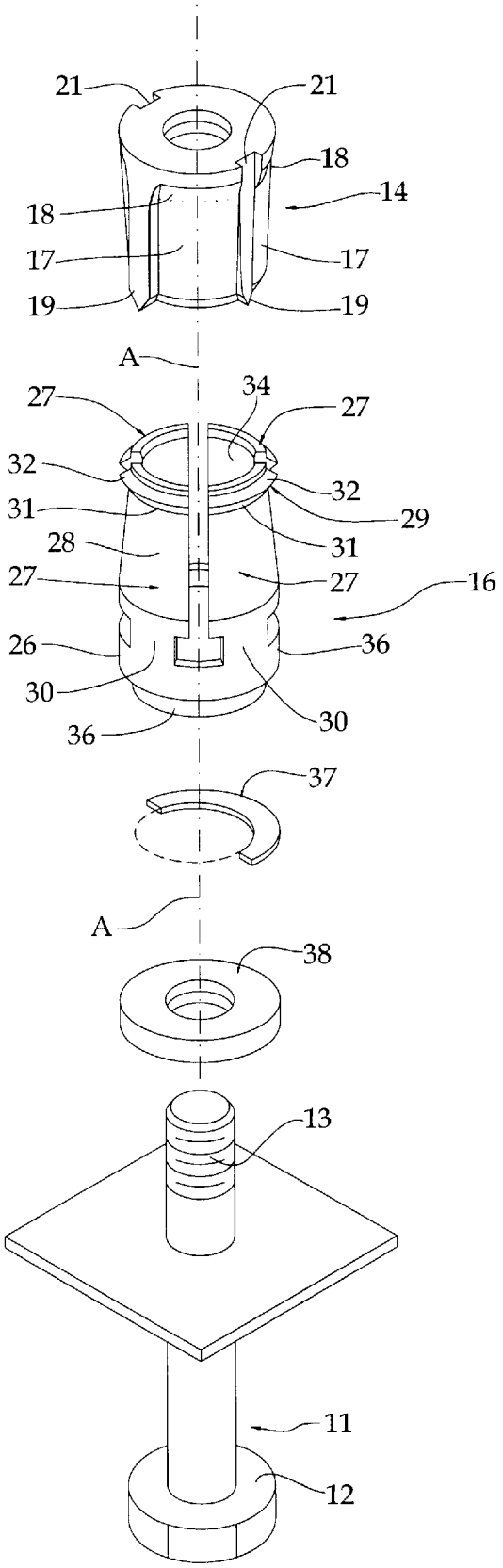
FIG. 4 is an exploded perspective view of the anchor and bolt.

Shell 16 may be formed from flat stock by rolling or may be made, from tubing in any suitable fashion. As may be seen in FIGS. 1–3, shell 16 includes an annular lower portion 26 which connects a plurality of segments 27 [generally cylindrical when formed about an axis A]. The outer surface of the shell 16 is dominated by a protruding rim 29 formed at the top of each segment 27. As will be noted hereinafter, each segment 27 is deflected outwardly to seat the anchor, however, prior to such deflection rim 29 extends substantially no further radially than annular portion 26. Intermediate rim 29 and annular portion 26 is the substantially smooth surface 28 of the segment which initially tapers inwardly from the annular portion 26 to the edge of the rim 29. Rim 29 has a conic surface 31 extending outwardly from the top of smooth surface 28 and a complimentary surface 32 tapering away from conic surface 31. Each segment 27 is formed with a reduced width portion 30 adjacent annular portion 26 to allow proper deflection as explained herein after. Interior surface of each segment 27 has formed thereon a bifurcated camming surface including an upper increased slope region 33 and a lower diminished slope region 34. Below diminished slope region 33 is a detent 35.

Figure 5:
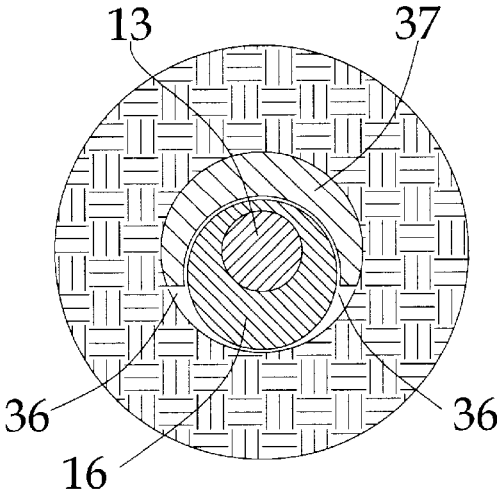
FIG. 5 is a sectional view taken along line 5—5 of FIG. 1 of a first type locking arrangement.
Figure 6:
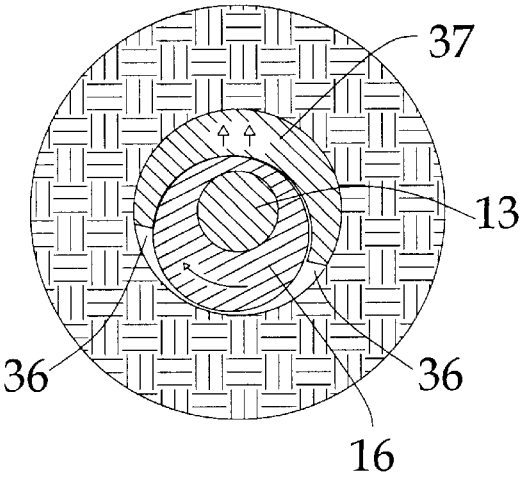
FIG. 6 is a sectional view of the first type locking arrangement shown after rotation of the bolt.
Figure 7:
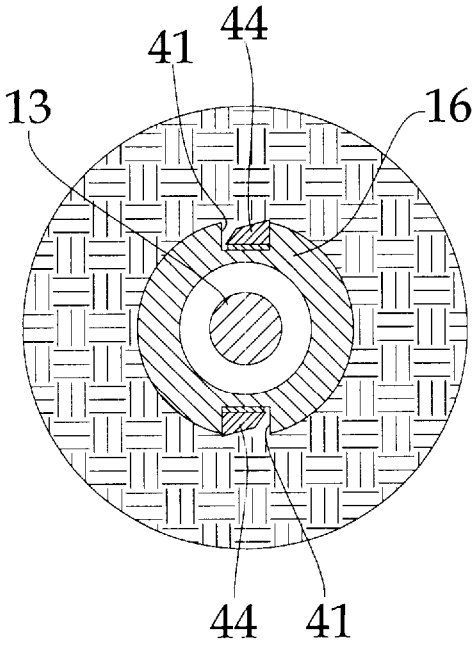
FIG. 7 is a sectional view of a second type locking arrangement.
Figure 8:
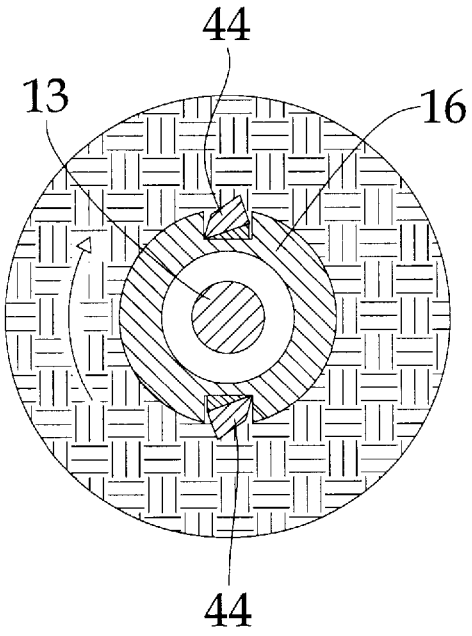
FIG. 8 is a sectional view of a second type locking arrangement shown after rotation of the bolt.

As will be appreciated camming nut 14 and shell 16 are drawn together by relative rotation of bolt 13, however, to cause such relative rotation something must retard the movement of shell 16. In one embodiment shell 16 is formed with an eccentric groove 36 formed therein relative to axis A as shown in FIG. 5. The shell 16 is placed on bolt 13 with the groove in registry with an eccentric washer 37 resting on nut 38 threaded on bolt 13 until it is stopped by the end of the thread. As the bolt 13 is rotated the eccentric washer 37 and the eccentric groove move relative to one another thereby forcing the washer against the wall in interference between the shell and wall such that the shell cannot freely rotate. Consequently, continued rotation of bolt 13 begins to move camming nut 14 downwardly. As the beveled lower edge of the nut 14 descends into the shell, the segments are bent outwardly at the reduced width portions thus rim 29 begins to penetrate the wall and compress the wall material. Conic surface 31 transfers substantial compressive force to the region of the wall outwardly and downwardly of the locus of engagement thereby providing a region of maximum compression immediately below the rim. Any material displaced and falling into the bore hole at this point is caught between the segments and the wall. Continued rotation of bolt 13 draws the nut further into the shell 16 displacing the smooth surfaces against the walls and bringing the entire wall outwardly into compression, there being a region of maximum compression adjacent rib 29 and an area of moderate compression over the length of the shell, with an annulus of displaced material extending into the bore beneath the shell.

Figure 9:
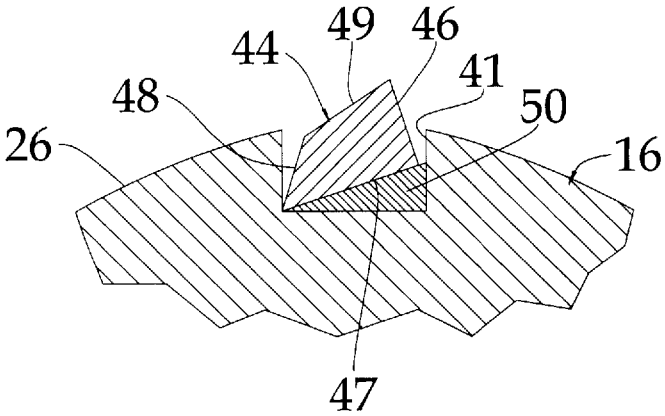
FIG. 9 is an enlarged sectional view of the components of the second type locking arrangement.
Figure 10:
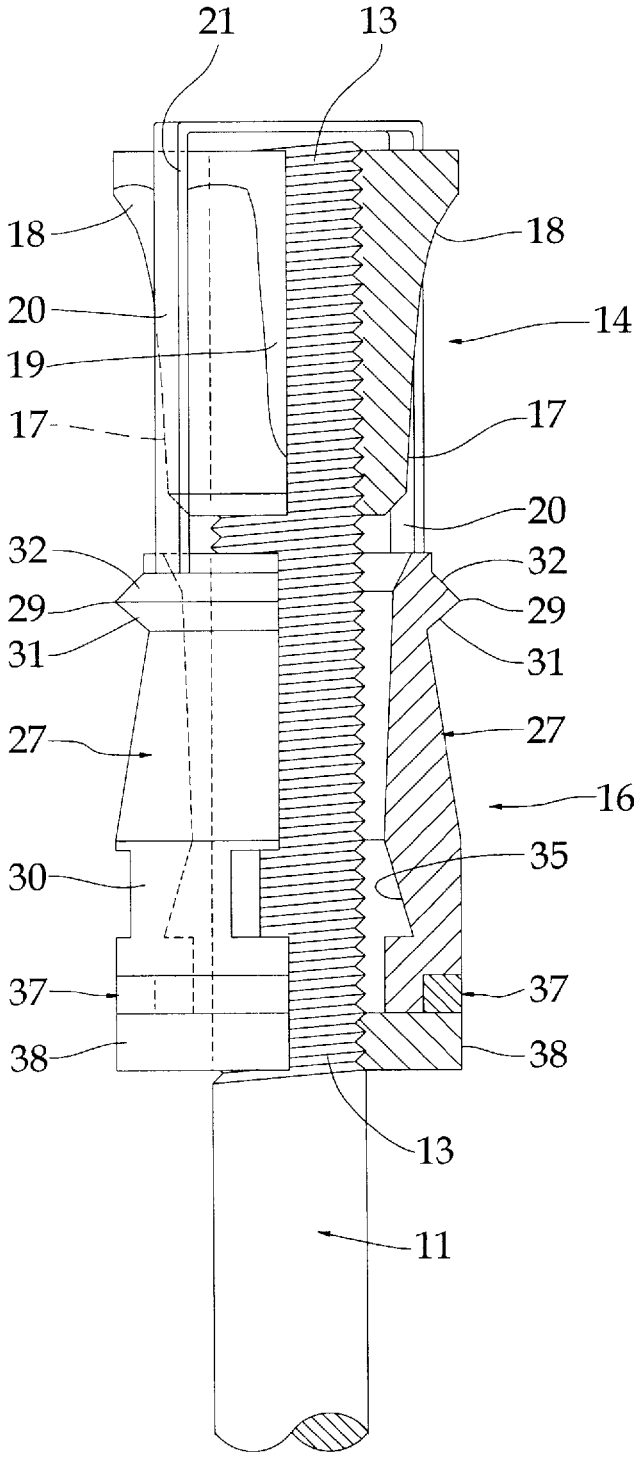
FIG. 10 is a side elevational view of an alternate embodiment of the anchor on a mine roof bolt.

In the embodiment shown in FIGS. 9 and 10, at least one annular slot 41 is formed in the annular portion 26. A polygonal tab 44 is formed with a leading edge 46 having a width slightly greater than the thickness of annular portion 26, a linear side 47 and a angled rear side 48 and a connecting side 49. A resilient mount 50 may be adhesively secured between side 47 and the slot. Tab 44 is inserted in slot 41 with resilient mounted urging leading edge 46 of tab 44 tab outwardly such that upon rotation of the shell within the bore hole by bolt 13, the tab engages the wall and attempts to pivot out of slot 41 about the intersection of linear side 47 and rear side 48, whereupon the tab is trapped in wedging interstitial engagement between shell 16 and the wall of the bore hole, thus the shell is restrained from rotation and the nut is drawn down into the shell as above. The nut may be guided into engagement with the shell by one or more upstanding guides 20 which engage grooves 21 formed in the nut, as shown in FIG. 10.

Tests with the anchor as described above have yielded stabilized tension at 90,000 Newton's as compared to tension at 40,000 to 50,000 Newton's in prior art devices. Mine roof bolt breakage is generally experienced at 120,000 Newton's, with a ¾th inch bolt. Maintaining the high tension in the bolt achieved by the claimed invention maintains the mine roof in compression, thereby lessening the likelihood of a fall due to loss of tension and compression in the anchor system.

What I claim is:

1. A mine roof bolt anchor, insertable in a pre-drilled hole in a mine roof, for expansion within said hole by rotation of an associated mine roof bolt, comprising, in combination:

a. a shell circumscribing said mine roof bolt and having a plurality of segments extending longitudinally of said bolt, said segments having a radially inward face defining a camming surface and terminating in a radially outwardly protruding rib;

b. a camming nut threadedly engaged on said mine roof bolt and having a radially outwardly flaring surface for engagement with said camming surface, said flaring surface having an abrupt variation in its slope proximal an upper end thereof;

c. means engagable with a wall of said hole upon rotation of said mine roof bolt for arresting the rotation of said shell relative thereto, such that further rotation of said mine roof bolt urges said camming nut linearly along the axis of said mine roof bolt displacing said segments radially such that said rib is forced into said wall and said segments are urged against said wall over a large surface area of said shell to compress said wall in the region beneath said rib.

2. The anchor as defined in claim 1, wherein said rib is substantially triangular in vertical cross section having a lower annular face flaring outwardly from said shell such that radial displacement of said rib against said wall applies downwardly outwardly directed compressive forces on an annular segment of said wall.

3. The anchor as defined in claim 1, wherein said camming surface of each segment is bifurcated having an upper cam surface and a lower cam surface, said upper cam surface having a greater outward radial slope than said lower cam surface.

4. The anchor as defined in claim 1, wherein said means for arresting rotation comprises at least one member having a surface displaceable from said bolt by rotation of said bolt relative to said bore hole wall.

5. The anchor as defined in claim 4 wherein said means for arresting rotation comprises a collar positioned about a portion of a lower margin of said shell said collar being eccentrically formed relative to said mine roof bolt and said shell such that rotation of said shell about the axis of said mine roof bolt compresses said collar between said shell and said bolt hole wall.

6. The anchor as defined in claim 4 wherein said means for arresting rotation comprises at least one tab member positioned in a slot formed in said shell and extending radially therebeyond with a leading edge of said tab engaging said wall of said bore hole such that rotation of said shell displaces said tab into interstitial locking engagement between said shell and said bore hole wall.

7. The anchor as defined in claim 1 wherein said camming nut has a plurality of longitudinal splines thereon positioned intermediate said segments of said shell such that said splines extend interstitially between said segments upon rotation of said mine roof bolt.

8. The anchor as defined in claim 1 wherein said camming nut has at least one groove formed therein longitudinally and said shell has at least one guide member engaged within said groove.

9. The anchor as defined in claim 8 wherein said guide means comprises a bail affixed to said shell.

10. An anchor for use with a mine roof bolt to be inserted into a pre-drilled hole in a mine roof, comprising in combination:

a. a segmented shell having a substantially cylindrical shape conforming to the outer diameter of said mine roof bolt for enclosing a portion thereof therein, said segment shell having a lower annulus and a plurality of upwardly oriented segments, each segment of said plurality of segments terminating at an outwardly extending rib and having an inner camming face formed thereon;

b. a camming nut threadedly engaged on said mine roof bolt superjacent said segmented shell in cooperative relation therewith such that rotation of said bolt relative to said nut moves said nut vertically, said nut having a flared outer surface engagable with said camming face of each segment; and, c. means for arresting rotational movement of said shell within said pre-drilled hole.

11. A mine roof anchor as defined in claim 10 where in each segment has a smooth outer surface subjacent said rib and each camming face has a lower portion flaring outwardly at a minimal angle from vertical and an upper portion flaring outwardly at a greater angle from vertical, said camming nut having a lower portion tapering outwardly at a first angle from vertical and an upper portion flaring outwardly at a substantially greater angle such that said smooth outer surface and said rib are urged against the wall of said drilled hole.

12. The mine roof anchor of claim 11 wherein said rib is has semi-annular conic section superjacent said smooth outer surface adapted to fracture and compress said wall of said drilled hole adjacent said smooth outer surface.

13. The mine roof anchor of claim 10 wherein said annulus has at least one slot formed therein and a tab member is positioned within said slot, said tab member having a first end extending radially beyond said slot and a second end engaged within said slot and tapering to a point such that rotation of said shell about a vertical axis within said drilled hole urges said first end against a wall of said hole and pivots said tab about said second end forcing said tab into interstitial interference between said shell and said wall of said drilled hole arresting the rotational movement of said shell.

14. The mine roof anchor of claim 13, wherein said camming nut has a plurality of splines thereon engagable between said segments such that said nut and said shell are restrained from relative angular movement.

15. The mine roof anchor of claim 10 wherein said annulus is formed with an annular groove eccentric relative to said mine roof bolt and further comprising an eccentric locking member engagable with said annular groove such that rotation of said segment about a vertical axis in said pre-drilled hole creates an interference fit between the wall of said hole, said locking member and said annulus within said annular groove.

* * * * *